United States Patent [19]

Davis et al.

[11] 4,207,197

[45] Jun. 10, 1980

[54] AGGLOMERATION PROCESS FOR MAKING GRANULAR DETERGENTS

[75] Inventors: Jerry E. Davis; Frank J. Mueller; Gerald W. Novosel; Robert A. Staab, all of Cincinnati, Ohio

[73] Assignee: The Procter & Gamble Company, Cincinnati, Ohio

[21] Appl. No.: 932,107

[22] Filed: Aug. 9, 1978

[51] Int. Cl.[2] ..... C11D 3/075; C11D 3/08; C11D 3/395; C11D 11/00

[52] U.S. Cl. ..... 252/99; 23/313 R; 23/313 AS; 252/174.14; 252/174.21; 252/135; 252/174; 252/383; 252/384; 252/385; 264/117

[58] Field of Search ..... 23/313 R, 313 AS; 252/89, 99, 135, 174, 383, 384, 385; 264/117

[56] References Cited

U.S. PATENT DOCUMENTS

| | | | |
|---|---|---|---|
| 2,689,225 | 9/1954 | Anderson | 252/99 |
| 2,895,916 | 7/1959 | Milenkevich | 252/99 |
| 3,154,496 | 10/1964 | Roald | 252/99 |
| 3,154,497 | 10/1964 | Mankowich | 252/135 |
| 3,247,118 | 4/1966 | Matthaei | 252/99 |
| 3,248,330 | 4/1966 | Feierstein | 252/99 |
| 3,520,815 | 7/1970 | Wessells | 252/99 |
| 3,598,743 | 8/1971 | Coates | 252/99 |
| 3,600,317 | 8/1971 | Lintner | 252/99 |
| 3,609,088 | 9/1971 | Sumner | 252/99 |
| 3,741,904 | 6/1973 | Christensen | 252/99 |
| 3,789,002 | 1/1974 | Weber | 252/99 |
| 3,812,045 | 5/1974 | Gray | 252/99 |
| 3,888,781 | 6/1975 | Kingry | 252/99 |
| 3,933,670 | 1/1976 | Brill | 252/99 |
| 4,077,897 | 3/1978 | Gault | 252/99 |

*Primary Examiner*—Dennis L. Albrecht
*Attorney, Agent, or Firm*—Edmund F. Gebhardt; Richard C. Witte; Thomas H. O'Flaherty

[57] ABSTRACT

Granular detergent compositions containing alkali metal polyphosphates are prepared by spraying an aqueous sodium silicate solution onto anhydrous alkali metal polyphosphates and optionally onto other dry ingredients, said aqueous sodium silicate solution containing from about 2% to about 20% by weight of a hydratable salt.

5 Claims, No Drawings

AGGLOMERATION PROCESS FOR MAKING GRANULAR DETERGENTS

BACKGROUND OF THE INVENTION

This invention relates to a process for making a granular detergent product and the product of the process. More particularly, the invention relates to a process for preparing detergent compositions which are useful in automatic dishwashing machines.

Detergent compositions comprising in combination an alkali metal polyphosphate such as sodium tripolyphosphate, alkaline salts such as sodium silicate and optionally sodium carbonate, and optionally a chlorine containing compound that provides hypochlorite ion in solution have particular utility for machine dishwashing. The production of such compositions made of agglomerates of the ingredients has been generally accomplished by the addition of an aqueous sodium silicate solution to a mixture of dry ingredients. However, compositions prepared in such manner are characterized by a tendency to cake in their cartons during storage and can also have a tendency to cake in the dispenser cups of automatic dishwashing machines. A number of process modifications have been suggested to reduce the caking tendency of detergent compositions prepared using silicate solutions as agglomerating agents. U.S. Pat. No. 2,895,916 discloses an order of addition in which a chlorine containing compound, chlorinated trisodium phosphate, is added to the composition only after the aqueous silicate has been added to an anhydrous polyphosphate. The benefit is said to result from a more rapid hydration of the sodium tripolyphosphate in the absence of chlorinated trisodium phosphate.

It has now been found that a substantial reduction in the carton caking tendency of agglomerated detergent compositions containing alkali metal polyphosphates and alkali metal silicates can be achieved if from about 2% to about 20% of a hydratable salt other than alkali metal silicate is incorporated in the aqueous silicate solution used to agglomerate the alkali metal polyphosphate and optionally other dry ingredients.

Accordingly, it is an object of this invention to produce agglomerated granular detergent compositions which are resistant to carton caking.

Other objects and advantages will be apparent from the following description and examples.

SUMMARY OF THE INVENTION

This invention comprises a process for preparing an agglomerated granular detergent composition comprising at least about 10% of an alkali metal polyphosphate, from about 50% to about 99.5% by weight of inorganic materials selected from the group consisting of alkali metal polyphosphates, orthophosphates, silicates, carbonates, acetates, sulfates and mixtures thereof and from about 0.5% to about 20% of a surfactant in which the agglomerating agent is an alkali metal silicate solution having a water content of from about 40% to about 75%, an average $SiO_2$:$M_2O$ weight ratio of from about 1.6 to about 3.3, M being an alkali metal, said solution containing from about 2% to about 20% of a hydratable salt. The present invention also comprises the granular detergent compositions characterized by resistance to caking which are made by the process.

Preferred detergent compositions of the present invention contain a compound providing hypochlorite ions in aqueous solution.

DETAILED DESCRIPTION OF THE INVENTION

The process of the invention is carried out in apparatus suitable for the mixing of dry particulate components and adapted so that liquid components such as the alkali metal silicate agglomerating agent can be sprayed on or otherwise added to a bed or falling curtain of one or more particulate components during the mixing operation. Any suitable mixing device such as an inclined pan agglomerator, a rotating drum or any other vessel with suitable means of agitation may be used. Methods of agitating, mixing and agglomerating particulate components are well-known to those skilled in the art. The apparatus may be designed or adapted for either continuous or batch operation so long as the essential process steps can be achieved.

Optional process steps include screening of particulate materials before processing, screening or grinding the final composition to any desired particle size, and allowing the final composition to come to equilibrium with respect to temperature and hydration before packing into cartons.

A theoretical basis for the unexpected improvement in caking resistance provided by incorporation of an hydratable salt in the aqueous alkali metal silicate solution is not clearly apparent. It is believed to be at least partially related to the complex hydration characteristics of polyphosphates. For example, a preferred anhydrous alkali metal polyphosphate is sodium tripolyphosphate. This compound has different hydration characteristics depending on its method of manufacture. A so-called Form I is produced if the process of manufacture includes a relatively high temperature calcination step. A Form II results when lower temperatures are employed. Form I is characterized by relatively rapid hydration characteristics. Form II, particularly in the absence of any substantial level of Form I material, is slow to hydrate, but has a greater immediate solubility. Commercially available sodium tripolyphosphates are generally a mixture of Form I and Form II. U.S. Pat. Nos. 2,622,068; 2,961,409 and 2,961,410, incorporated herein by reference disclose the hydration characteristics of Form I and Form II sodium tripolyphosphate in the manufacture of spray-dried detergents.

In the agglomeration process of the present invention a relatively rapid, but controlled hydration is desirable. It is clearly desirable to achieve hydration equilibrium before packing product in cartons. Too rapid a hydration, however, can result in a temperature rise which complicates agglomeration and can result in product deterioration, e.g., breakdown of compounds that provide hypochlorite ion in solution. It is also theorized that the reduction in carton caking achieved by the practice of the invention is due in part to a modification of the tendency of alkali metal silicate to form bonds between adjacent agglomerates.

The process and product of this invention apply to granular detergent compositions comprising the following essential ingredients: (1) alkali metal polyphosphates; (2) alkali metal silicates; (3) a hydratable salt and (4) a surfactant.

THE ALKALI METAL POLYPHOSPHATE

The detergent compositions made by the process of the invention contain one or more alkali metal polyphosphates at a total level of at least about 10% and preferably from about 20% to about 50% by weight. Polyphosphates useful in the practice of the invention are the water-soluble sodium and potassium salts of pyrophosphoric acid ($H_4P_2O_7$), tripolyphosphoric acid ($H_5P_3O_{10}$), and polymeric metaphosphoric acid $(HPO_3)n$. The value of n is typically below about 50 in the interest of water solubility. The sodium and potassium salts of metaphosphoric acid are often designated "glassy" phosphates and exist as a series of polymers. Glassy phosphates may also be represented by the formula $(M_2O)m(P_2O_5)n$ wherein M is an alkali metal, n is in the range of from about 5 to about 50 and m:n is in the range of 1:1 to 1:1.5 on a molar basis. An example of a glassy phosphate is sodium hexametaphosphate ($Na_6P_6O_{18}$). Sodium tripolyphosphate ($Na_5P_3O_{10}$) is a preferred alkali metal polyphosphate because of its stability and the fact that it does not form insoluble salts with the calcium or magnesium ions present in water or soils.

THE ALKALI METAL SILICATE

The compositions made by the process of this invention contain alkali metal silicates generally at a level of from about 5% to about 25% on an anhydrous weight basis. Particularly preferred is a sodium silicate having a weight ratio of $SiO_2$:$Na_2O$ of from about 1.6 to about 3.3, most preferably from about 2 to about 3.2. Lower ratio silicates which are relatively more alkaline provide good cleaning performance but in order to provide protection to materials such as aluminum and china, it is desirable to have at least 10% and up to 75% of the $SiO_2$ present at a $SiO_2$:$Na_2O$ ratio above 3.0. It is possible to add all of the silicate in the form of aqueous solution typically containing from about 35% to about 45% silicate solids but a portion may be part of the dry mix as will be apparent in the examples. The alkali metal silicate solutions used as agglomerating agents in the practice of the invention contain from about 40% to about 75% water, preferably from about 50% to about 65% water.

THE HYDRATABLE SALT

The aqueous alkali metal silicate solution used in the process of the invention contains from about 2% to about 20% of a hydratable salt other than alkali metal silicates. Preferably the salt in at least one hydrated form is stable at about 30° C.

Among suitable hydratable salts are sodium orthophosphate, chlorinated sodium orthophosphate, sodium pyrophosphate, sodium tripolyphosphate, sodium metaphosphate, sodium sulfate, sodium acetate, sodium citrate and sodium carbonate. Potassium or ammonium salts, acid salts, and compounds such as acids that can form hydratable salts in the presence of the alkaline aqueous alkali metal silicate solution are also suitable. The material added to the aqueous silicate solution need not be immediately water-soluble or soluble in the silicate solution. Preferably, however, the hydratable salt does not result in the presence of water insoluble material in the detergent compositions of the invention.

The hydratable salt can have a use in the washing process, e.g., sodium tripolyphosphate as a detergency builder and chlorinated trisodium phosphate as a source of hypochlorite ions and alkalinity. Alternately, the hydratable salt may act only to improve caking resistance according to the purpose of the invention, e.g., sodium sulfate.

THE OPTIONAL HYPOCHLORITE ION COMPOUND

The source of hypochlorite ion is a chlorine bleach component, a compound which contains chlorine in active form. The ability of a compound to provide hypochlorite ion in solution is generally measured as "available chlorine". The available chlorine reflects the method of producing an inorganic hypochlorite (e.g., $2\ NaOH + Cl_2 \rightarrow NaOCl + NaCl + H_2O$). Available chlorine is the chlorine liberated by acidification of a solution of hypochlorite ions and at least a molar equivalent amount of chloride ions. The usual analytical method of determining available chlorine in a solution is addition of an excess of an iodide salt and titration of the liberated free iodine with a reducing agent. The compositions provided by the process of this invention preferably have hypochlorite ion producing compounds in an amount sufficient to provide available chlorine equal to from about ½% to about 4% by weight of the composition. This corresponds to about 0.52% to 4.2% by weight of sodium hypochlorite.

The preferred source of available chlorine is chlorinated trisodium phosphate.

The term "chlorinated trisodium phosphate" designates a composition consisting of trisodium phosphate and sodium hypochlorite in intimate association in the crystalline form. A nominal formula is $4(Na_3PO_4.11H_2O).NaOCl$. Commercially available chlorinated trisodium phosphate typically contains from 1% to 5% available chlorine and can be prepared by the methods of U.S. Pat. Nos. 1,555,474 or 1,965,304 or modifications thereof, incorporated herein by reference.

Although the preferred source of available chlorine is chlorinated trisodium phosphate, other materials which can be used are sodium and potassium dichlorocyanurates, dichlorocyanuric acid; 1,3-dichloro-5,5-dimethyl hydantoin; N,N'-dichlorobenzoylene urea; paratoluene sulfondichloroamide; trichloromelamine; N-chloroammeline; N-chlorosuccinimide; N,N'-dichloroazodicarbonamide; N-chloroacetyl urea; N,N'-dichlorobiuret; chlorinated dicyandiamide; sodium hypochlorite; calcium hypochlorite; and lithium hypochlorite. Of the materials other than chlorinated trisodium phosphate, alkali metal dichlorocyanurates are preferred for effectiveness, stability and availability.

THE SURFACTANT

The compositions of this invention contain from about 0.5% to about 20% surfactant by weight. A preferred level of surfactant is from about 2% to about 10%. Preferably the surfactant is an alkoxylated nonionic surfactant and preferably the composition is essentially free of sulfonated or sulfated anionic surfactants.

Examples of nonionic surfactants include:

(1) the condensation product of 1 mole of a saturated or unsaturated, straight or branched chain, alcohol or fatty acid containing from about 10 to about 20 carbon atoms with from about 4 to about 50 moles of ethylene oxide. Specific examples of such compounds include a condensation product of 1 mole of coconut fatty acid or tallow fatty acid with 10 moles of ethylene oxide; the condensation of 1 mole of oleic acid with 9 moles of ethylene oxide; the condensation product of 1 mole of stearic acid with 25 moles of ethylene oxide; the condensation product of 1 mole of tallow fatty alcohols with about 9 moles of ethylene oxide; the condensation product of 1 mole of oleyl alcohol with 10 moles of ethylene oxide; the condensation product of 1 mole of $C_{19}$ alcohol and 8 moles of ethylene oxide; and the condensation product of one mole of $C_{18}$ alcohol and 9 moles of ethylene oxide.

The condensation product of a fatty alcohol containing from 17 to 19 carbon atoms, and being substantially free of chain lengths above and below these numbers, with from about 6 to about 15 moles, preferably 7 to 12 moles, most preferably 9 moles, of ethylene oxide is particularly preferred, especially when capped with a low molecular weight ($C_{1-5}$) acid or alcohol moiety, so as to minimize or eliminate the need for a suds-suppressing agent. Suds-suppressing agents tend to reduce cleaning performance.

(2) Polyethylene glycols having molecular weights of from about 1,400 to about 30,000, e.g., 20,000 9,500; 7,500; 6,000; 4,500; 3,400; and 1,450. All of these materials are waxlike solids which melt between 110° F. and 200° F.

(3) The condensation products of 1 mole of alkyl phenol wherein the alkyl chain contains from about 8 to about 18 carbon atoms and from about 4 to about 50 moles of ethylene oxide. Specific examples of these nonionics are the condensation products of 1 mole of decylphenol with 40 moles of ethylene oxide; the condensation product of 1 mole of dodecyl phenol with 35 moles of ethylene oxide; the condensation product of 1 mole of tetradecylphenol with 25 moles of ethylene oxide; the condensation product of 1 mole of hectadecylphenol with 30 moles of ethylene oxide, etc.

(4) Polyoxypropylene, polyoxyethylene condensates having the formula $HO(C_2H_4O)x(C_3H_6O)y\ (C_2H_4O)x\ H$ where y equals at least 15 and $(C_2H_4O)x+x$ equals 20% to 90% of the total weight of the compound and the molecular weight is from about 2,000 to about 10,000, preferably from about 3,000 to about 6,000. These materials are, for example, the Pluronics which are well known in the art.

(5) The compounds of (1) which are capped with propylene oxide, butylene oxide and/or short chain alcohols and/or short chain fatty acids, e.g., those containing from 1 to about 5 carbon atoms, and mixtures thereof.

Preferred surfactants are those having the formula $RO—(C_2H_4O)_xR^1$ wherein R is an alkyl or alkylene group containing from 17 to 19 carbon atoms, x is a number from about 6 to about 15, preferably from about 7 to about 12, and $R^1$ is selected from the group consisting of: preferably, hydrogen, $C_{1-5}$ alkyl groups, $C_{2-5}$ acyl groups and groups having the formula $—(C_yH_{2y}O)_nH$ wherein y is 3 to 4 and n is a number from 1 to about 4.

Also preferred are the low sudsing compounds of (4), the other compounds of (5), and the $C_{17-19}$ materials of (1) which have a narrow ethoxy distribution.

In addition to the above mentioned surfactants, other suitable surfactants can be found in the disclosure of U.S. Pat. Nos. 3,544,473, 3,630,923, 3,888,781 and 4,001,132, all of which are incorporated herein by reference.

ALKALI METAL CARBONATES AND ORTHOPHOSPHATES

Optionally, the process and composition of the invention utilize alkali metal, particularly sodium carbonate and orthophosphate to provide the alkalinity reserve needed for optimum cleaning performance. The preferred source of available chlorine, chlorinated trisodium phosphate, thus has a dual function when used in the compositions of the invention at a preferred level of from about 15% to about 40% by weight. Nonchlorinated alkali metal orthophosphates can be used, particularly when an organic chlorine bleach such as potassium dichlorocyanurate is the source of hypochlorite ions.

Alkali metal carbonates, particularly sodium carbonate, can be present in the compositions at levels up to about 20%, preferably from about 2% to about 12% by weight. In a preferred embodiment, the alkali metal carbonate or a mixture of alkali metal carbonate and other dry ingredients, especially alkali metal silicates, are used to absorb all of part of the nonionic surfactant. In a particularly preferred embodiment, as disclosed in the concurrently filed, commonly assigned patent application of Davis et al. U.S. Ser. No. 932,109, one portion of the liquid nonionic surfactant is mixed with and absorbed into dry components and a second portion is added to the anhydrous alkali metal polyphosphate at some point in time concurrent with the addition of the aqueous silicate solution. The rate of hydration of the polyphosphate can be adjusted and controlled by the presence of the surfactant added directly to the polyphosphate. Absence of surfactant or addition after essentially all the aqueous silicate provides the most rapid hydration. If a portion of surfactant is added prior to or in the early part of the aqueous silicate addition the rate of polyphosphate hydration is decreased. Control of hydration rate prevents a rapid temperature increase or absorption of all water before satisfactory agglomeration.

OTHER OPTIONAL INGREDIENTS

In addition to the above ingredients it can be desirable, if the product sudses too much, to incorporate one of the many suds-suppressing ingredients disclosed in the above mentioned patents which have been incorporated by reference at a level of from about 0.001% to about 10%, preferably from about 0.05% to about 3%. The preferred suds suppressing materials are mono- and distearyl acid phosphates; the self-emulsified siloxane suds-suppressors of pending U.S. patent application Ser. No. 841,078, filed Oct. 11, 1977, by T. W. Gault and Edward John McGuire, Jr. and mixtures thereof.

Organic sequestering builders such as citrates and nitrilotriacetates can be present in the compositions, but preferably at levels no greater than about 10% by weight. The presence of organic builders tends to hurt the performance of these compositions by leaving visible spots and filming on glassware. The polyphosphate builders are relatively free of these deficiencies.

China protecting agents including aluminosilicates, aluminates, etc., can be present in amounts up to about 5%, preferably from about 0.2% to about 2%.

Filler materials to control product physical characteristics can also be present including sodium acetate, sucrose, sucrose esters, sodium chloride, sodium sulfate, etc., in amounts up to about 60%, preferably not more than about 30%.

Hydrotrope materials such as sodium benzene sulfonate, sodium toluene sulfonate, sodium cumene sulfonate, etc., can be present in minor amounts, but, as with other organic materials, their presence is normally minimized.

Dyes, perfumes, crystal modifiers and the like can also be added in minor amounts.

As used herein, all percentages, parts and ratios are by weight unless otherwise stated.

The following Examples illustrate the invention and facilitate its understanding.

EXAMPLE I 45.3 parts by weight of granular anhydrous sodium tripolyphosphate was added to a ribbon mixer. With the mixer in operation the following ingredients were added during a cycle time of 183 seconds:

(a) from 8 seconds to 153 seconds—added as a spray 16.7 parts of aqueous silicate solution containing 43% sodium silicate with a $SiO_2$:$Na_2O$ ratio of 2.58 premixed with 16.7 parts of aqueous silicate solution containing 37.5% sodium silicate with a $SiO_2$:$Na_2O$ ratio of 3.2. This solution also contained minor amounts of perfume and dye solution.

(b) from 45 seconds to 147 seconds—added as a spray 2.7 parts of a polyoxyalkylene nonionic surfactant (Pluradot HA-433, BASF Wyandotte Corp., a polyethylene oxide—polypropylene oxide copolymer containing a monostearyl acid phosphate suds suppressor)

(c) from 108 seconds to 115 seconds—added dry 22.1 parts of chlorinated sodium phosphate with 3.5% available chlorine and including 10.5 parts of water of crystallization.

(d) from 153 seconds to 183 seconds

Product is discharged from mixer.

A second detergent composition was prepared in accordance with the above procedure except that the mixture of sodium silicate solutions contained 10% by weight (3.7 parts) of granular anhydrous tripolyphosphate to form a slurry containing dissolved silicate and both suspended and dissolved sodium tripolyphosphate. The slurry was sprayed on to 41.6 parts of anhydrous sodium tripolyphosphate.

Additional compositions were prepared in which 3%, 5% and 15% of sodium tripolyphosphate was added to the aqueous silicate solution.

The compositions were packed in 50 oz. cardboard cartons with a polyethylene film laminate and an aluminum foil overwrap. The resistance to carton caking was measured after storage time and conditions as indicated in the table below. A mechanized pouring testing device was used to evaluate the samples. The device rotates opened cartons through a 100° arc, stops briefly and then returns the carton to an upright position. This procedure is repeated to determine a "free pour" grade. Following the free pour test cycle, cartons with any remaining product are subjected to four "shake-pour" cycles which repeat the 100° arc of the carton with a gentle continuous lateral shaking action. This procedure provides a "total pour" grade.

| Percent Product Removed (Free Pour/Total Pour) Storage Temperature (°F.) | 90° F. | | | |
|---|---|---|---|---|
| Storage Time (Weeks) | 1 | 2 | 3 | 4 |
| Product (% Sodium tripolyphosphate in silicate solution) | | | | |
| Test #1 | | | | |
| 0% control | 7/31 | 2/6 | — | 1/3 |
| 5% | 22/60 | 11/42 | — | 3/5 |
| 10% | 71/100 | 58/95 | — | 12/33 |
| Test #2 | | | | |
| 0% control | 16/42 | 6/35 | 4/9 | 4/8 |
| 10% | 79/100 | 44/97 | 25/70 | 47/82 |
| 15% | 100/100 | 87/100 | 40/98 | 68/99 |
| Test #3 | | | | |
| 0% control | 28/59 | 6/18 | 11/34 | 11/14 |
| 1% | 28/71 | 7/11 | 12/32 | 15/25 |
| 3% | 66/96 | 29/71 | 26/66 | 20/58 |
| 5% | 42/87 | 17/46 | 11/41 | 16.39 |
| Test #4 | | | | |
| 0% control | 12/36 | 19/53 | 7/20 | 3/16 |
| 10% - Sample #1 | 78/100 | 55/92 | 53/100 | 17/64 |
| 10% - Sample #2 | 72/92 | 40/99 | 53/87 | 13/65 |

| Storage Temperature (°F.) | 78° F.-94° F. daily cycle | | | |
|---|---|---|---|---|
| Storage Time (Weeks) | 2 | 4 | 6 | 8 |
| Product (% Sodium tripolyphosphate in silicate solution) | | | | |
| Test #1 | | | | |
| 0% control | 15/36 | 3/13 | | 3/6 |
| 5% | 46/90 | 12/54 | | 16/39 |
| 10% | 86/100 | 65/99 | | 26/79 |
| Test #2 | | | | |
| 0% control | 8/33 | 4/11 | 2/4 | |
| 10% | 69/100 | 59/95 | 38/97 | |
| 15% | 82/100 | 92/100 | 72/100 | |
| Test #3 | | | | |
| 0% control | 21/51 | 10/25 | | |
| 1% | 19/54 | 7/32 | | |
| 3% | 26/84 | 14/41 | | |
| 5% | 25/75 | 17/48 | | |
| Test #4 | | | | |
| 0% control | — | 8/19 | | |
| 10% - Sample #1 | — | 38/85 | | |
| 10% - Sample #2 | — | 40/97 | | |

Under both test conditions products in which 3%, 5%, 10% and 15% of sodium tripolyphosphate was incorporated in the aqueous silicate solution had a substantially reduced caking tendency relative to the control after exposure to high temperature storage conditions.

A similar improvement is obtained for products in which sodium pyrophosphate replaces the sodium tripolyphosphate in the aqueous silicate solution.

A similar improvement is obtained for products in which sodium hexametaphosphate replaces the sodium tripolyphosphate in the aqueous silicate solution.

A similar improvement is obtained when powdered sodium tripolyphosphate replaces 50% of the granular sodium tripolyphosphate in the total composition.

A similar improvement is obtained when 5 parts potassium dichlorocyanurate and 17.1 parts anhydrous sodium carbonate replace 22.1 parts of chloronated trisodium.

A similar improvement is obtained when 2% sodium acetate is incorporated in the aqueous silicate solution.

A similar improvement is obtained when potassium citrate replaces the sodium tripolyphosphate in the aqueous silicate solution.

A similar improvement is obtained when sodium carbonate replaces the sodium tripolyphosphate in the aqueous silicate solution.

EXAMPLE II

Compositions were prepared according to the process of Example I in which the aqueous sodium silicate solution contained 5% sodium sulfate, 8% sodium sulfate and 10% chlorinated trisodium phosphate (CL-TSP) by weight. The sodium sulfate was added in addition to other ingredients on a parts basis; the chlorinated trisodium phosphate (3.7 parts) added to the silicate was subtracted from the 22.1 parts of dry chlorinated trisodium phosphate of the control product.

The compositions were packed into 50 oz. polyethylene laminated, aluminum foil overwrapped cardboard cartons as described in Example I a compositions were stored at elevated temperatures and evaluated for carton caking by the test method described in Example I.

| Percent Product Removed (Free Pour/Total Pour) Storage Temperature (°F.) | 90° F. | | | |
|---|---|---|---|---|
| Storage Time (Weeks) | 1 | 2 | 3 | 4 |
| Test #1 | | | | |
| Control | 84/100 | 19/74 | 25/54 | 1/3 |
| 5% $Na_2SO_4$ | 100/100 | 84/100 | 75/100 | 47/90 |
| Test #2 | | | | |
| Control #1 | 19/64 | | | |
| Control #2 | 15/44 | | | |
| 5% $Na_2SO_4$ | 96/100 | | | |
| 8% $Na_2SO_4$ | 83/100 | | | |
| Test #3 | | | | |
| Control | 12/36 | 19/53 | 7/20 | 3/16 |
| 10% CL-TSP | 42/99 | 3/94 | 36/84 | 24/63 |

| Percent Product Removed (Free Pour/Total Pour) Storage Temperature (°F.) | 78° F.–94° F. daily cycle | | |
|---|---|---|---|
| Storage Time (Weeks) | 2 | 4 | 8 |
| Test #1 | | | |
| Control | 15/75 | 59/90 | |
| 5% $Na_2SO_4$ | 100/100 | 93/100 | |
| Test #2 | | | |
| Control #1 | | | |
| Control #2 | | | |
| 5% $Na_2SO_4$ | | | |
| 8% $Na_2SO_4$ | | | |
| Test #3 | | | |
| Control | — | 8/19 | 2/3 |
| 10% CL-TSP | — | 26/74 | 7/32 |

EXAMPLE III 35 parts of chlorinated trisodium phosphate were loaded into a rotating drum mixer. 5.0 parts of Pluradot HA-433 nonionic surfactant were sprayed on the chlorinated trisodium phosphate with continuous mixing. 23.5 parts of anhydrous powdered sodium tripolyphosphate and 6.0 parts of granular hydrated sodium silicate (81% solids with $SiO_2$:$Na_2O$ ratio of 2.4) were added. 31.4 parts of an aqueous sodium silicate solution (15.7 parts 2.0 ratio, 44% solids and 15.7 parts 3.2 ratio, 37.5% solids) and 2.5 parts of Pluradot HA-433 are sprayed on the dry mixture to form an agglomerated detergent composition.

A second detergent composition was prepared by the same process except that the aqueous sodium silicate solution containing 3.4 parts of the total sodium tripolyphosphate (10% of the silicate solution by weight).

EXAMPLE IV 6.0 parts of granular hydrated sodium silicate (81% solids, 2.4 ratio) were added to a rotating drum mixer and 2.5 parts Pluradot HA-433 were sprayed on the silicate with continuous mixing. 23.5 parts of powdered anhydrous sodium tripolyphosphate are added. 16.9 parts of an aqueous sodium silicate solution (9.2 parts 2.0 ratio, 44% solids and 7.7 parts 3.2 ratio, 37.5% solids) and 5.0 parts Pluradot HA-433 are sprayed on the mixture of dry ingredients. When approximately 70% of the aqueous silicate had been added, 35.0 parts of chlorinated trisodium phosphate were added.

A second detergent composition was prepared by the same process except that 1.88 parts of tripolyphosphate was added to the aqueous sodium silicate solution.

EXAMPLE V 10.0 parts anhydrous sodium carbonate and 22.0 parts chlorinated trisodium phosphate were added to a rotating drum mixer. With continuous mixing 5.0 parts of Pluradot HA-433 were sprayed on the mixture. 26.0 parts of powdered anhydrous sodium tripolyphosohate and 6.0 parts of granular hydrated sodium silicate (81% solids, 2.4 ratio) were added and 31.4 parts of an aqueous sodium silicate solution (15.7 parts 2.0 ratio 44% solids and 15.7 parts 3.2 ratio 37.5% solids) and 2.5 parts of Pluradot HA-433 were sprayed on the mixture of dry ingredients to form an agglomerated detergent composition.

A second detergent compostion was prepared by the same process except that 3.5 parts of powdered anhydrous sodium tripolyphosphate was added to the aqueous sodium silicate solution.

Compositions of this example were also prepared in a ribbon mixer.

The compositions of Examples III, IV, and V were packed into 35 oz. polyethylene laminated, aluminum foil overwrapped cardboard cartons. The compositions were stored at elevated temperatures and evaluated for carton caking by the test method described in Example I.

| Percent Product Removed (Free Pour/Total Pour) Storage Temperature (°F.) | 90° F. | | |
|---|---|---|---|
| Storage Time (Weeks) | 1 week | 2 weeks | 3 weeks |
| Product | | | |
| Example III | | | |
| No polyphosphate in silicate solution | | | |
| Batch 1 | 70/100 | — | 35/50 |
| Batch 2 | 62/77 | 16/46 | 18/36 |
| 10% polyphosphate in silicate solution | | | |
| Batch 1 | 96/100 | 95/100 | 47/100 |
| Batch 2 | 36/67 | 27/58 | 16/26 |
| Example IV | | | |
| No polyphosphate in silicate solution | 0/84 | 3/34 | 6/15 |
| 10% of polyphosphate in silicate solutions | 41/100 | 23/62 | 35/97 |
| Example V | | | |

-continued

| Percent Product Removed (Free Pour/Total Pour) Storage Temperature (°F.) | 90° F. | | |
|---|---|---|---|
| Storage Time (Weeks) | 1 week | 2 weeks | 3 weeks |
| No polyphosphate in silicate solution | | | |
| Rotating Drum Mixer | 90/100 | 27/57 | 22/41 |
| Ribbon Mixer | 57/100 | 55/68 | 23/72 |
| 10% of polyphosphate in silicate solution | | | |
| Rotating Drum Mixer | 89/100 | 28/72 | 55/84 |
| Ribbon Mixer | 80/100 | 65/95 | 43/90 |

In general, products in which 10% polyphosphate was incorporated in the aqueous silicate solution had a substantially reduced caking tendency relative to corresponding compositions in which no polyphosphate was incorporated in the aqueous silicate.

What is claimed is:

1. A process for preparing an agglomerated granular detergent composition comprising at least about 10% of an alkali metal polyphosphate, from about 50% to about 99.5% by weight of inorganic material selected from the group consisting of alkali metal polyphosphates, orthophosphates, silicates, carbonates, acetates, sulfonates and mixtures thereof and from about 0.5% to about 20% of an alkoxylated nonionic surfactant in which the agglomerating agent comprises an alkali metal silicate solution having a water content of from about 40% to about 75%, an average $SiO_2$:$M_2O$ weight ratio of from about 1.6 to about 3.3, M being an alkali metal, said agglomerating agent containing from about 2% to about 20% based on the weight of agglomerating agent of a hydratable salt selected from the group consisting of alkali metal orthophosphates, chlorinated orthophosphates, polyphosphates, sulfates, and mixtures thereof, said granular detergent composition comprising a material providing hypochlorite ions in aqueous solution, said process comprising agitating one or more of said inorganic materials in the form of particulate components, contacting said particulate components with said agglomerating agent during said agitating, mixing said agglomerating agent with said one or more particulate components by continuing said agitating for a period of time sufficient to produce an agglomerated granular detergent composition and recovering said agglomerated detergent composition.

2. The process of claim 1 wherein the alkali metal silicate solution comprises from about 3% to about 15% by weight of a hydratable salt.

3. The process of claim 1 wherein the alkoxylated nonionic surfactant comprises from about 2% to about 10% by weight of the agglomerated granular detergent composition.

4. The process of claims 1 or 3 wherein the material providing hypochlorite ions is chlorinated sodium orthophosphate.

5. An agglomerated granular detergent composition prepared according to the process of claim 1.

* * * * *